US005180170A

United States Patent [19]

Lowrance

[11] Patent Number: 5,180,170

[45] Date of Patent: Jan. 19, 1993

[54] MICROSWITCH ACTIVATING DEVICE FOR FISHING GAME APPARATUS

[76] Inventor: Arlen J. Lowrance, 2121 S. Yorktown #802, Tulsa, Okla. 74114

[21] Appl. No.: 745,545

[22] Filed: Aug. 15, 1991

Related U.S. Application Data

[63] Continuation-in-part of Ser. No. 667,178, Mar. 11, 1991, Pat. No. 5,094,461.

[51] Int. Cl.[5] ..... A63F 9/00

[52] U.S. Cl. ..... 273/343; 273/140; 273/393; 200/331

[58] Field of Search ..... 273/393, 343, 345, 346, 273/347, 348, 350, 378, 383, 140; 200/331

[56] References Cited

U.S. PATENT DOCUMENTS

| | | | |
|---|---|---|---|
| 1,699,409 | 1/1929 | Stevens | 200/331 |
| 2320,145 | 5/1943 | La Due | 273/350 |
| 2,393,726 | 1/1946 | Yejoff | 273/140 |
| 2,482,057 | 9/1949 | Fincke | 273/393 |
| 2,511,430 | 6/1950 | Colaluca | 273/393 |
| 2,598,487 | 5/1952 | Anechiarico | 273/140 X |
| 2,611,617 | 9/1952 | Strohm | 273/140 |
| 2,703,469 | 3/1955 | Raizen | 273/140 |
| 2,726,303 | 12/1955 | Berndsen | 200/331 |
| 2,931,878 | 4/1960 | Eisenberg | 200/331 |
| 3,463,494 | 8/1969 | Stroh | 273/345 |
| 3,617,676 | 11/1971 | Dennison | 200/331 |
| 3,620,532 | 11/1971 | Graf | 273/140 X |
| 3,959,618 | 5/1976 | Carroll | 200/339 |
| 3,997,750 | 12/1976 | Glazer | 200/331 |
| 4,115,669 | 9/1978 | Cali | 200/331 |
| 4,256,943 | 3/1981 | Whitlock | 200/331 |
| 4,615,624 | 10/1986 | Goodrich | 368/1 |
| 4,976,439 | 12/1990 | Kraemer | 273/350 |
| 5,094,461 | 3/1992 | Lowrance | 273/343 |

*Primary Examiner*--William H. Grieb
*Attorney, Agent, or Firm*—William S. Dorman

[57] ABSTRACT

An actuating rod for a microswitch used to actuate a time for a fishing game apparatus. The timing mechanism is actuated by a microswitch having a momentary toggle arm. The actuating rod has a lower end with a longitudinal bore therein. The size of the bore is such that the actuating rod can be snugly received over the toggle arm of the microswitch. The upper end of the actuating rod is provided with a vertical notch which extends downwardly. The actuating rod also preferably includes a circular opening or eye disposed above the notch. Each preselected fish-shaped member is provided with a string which connects at one end to the preselected fish-shaped member and which is provided with a knot at the other end of the string. The strings from the two preselected fish-shaped members are inserted into the opening in the actuating rod and slipped into the vertical notch.

2 Claims, 2 Drawing Sheets

MICROSWITCH ACTIVATING DEVICE FOR FISHING GAME APPARATUS

CROSS REFERENCE TO OTHER APPLICATIONS

This Application is a continuation-in-part of co-pending application Ser. No. 07/667,178, filed on Mar. 11, 1991, entitled "Fishing Game Appartus", now U.S. Pat. No. 5,094,461, granted Mar. 10, 1992.

BACKGROUND OF THE INVENTION

1. Field of the Invention

The present invention relates to an apparatus or device for actuating a microswitch for a timer in a fishing game device which can be used to simulate fishing. More particularly, the apparatus of the present invention includes a rod which can be attached to the toggle arm of the microswitch, the rod being designed to receive the ends of strings which are secured to "fish" used in the fishing game apparatus.

2. The Prior Art

There are numerous games or devices wherein "fish" are involved as game pieces or tokens. However, the prior art does not disclose a fishing device or apparatus of the type disclosed in co-pending application Ser. No. 07/667,178, filed Mar. 11, 1991 on "Fishing Game Apparatus".

In the aforementioned co-pending application, there is a timer which is used to measure the lapsed time between the securing or "catching" of the first fish and the catching of the last fish in the sequence of catches. However, the timer in the aforementioned co-pending application is actuated in response to the rotation of a cam which, in turn, is rotated by an arm which connects by two separate strings attached to the first and last fish, referred to above. That is, when the first fish is removed from the apparatus of the aforementioned co-pending application, the associated string will pull on the arm, turn the cam, and actuate the microswitch to start the timer; similarly, when the last fish is removed from the apparatus of the aforementioned co-pending application, the string on the last fish will pull on the arm to turn the cam to activate the microswitch and stop the timer. The strings on the two fish in the aforementioned co-pending application are releasably attached to the aforementioned arm.

The present invention eliminates the cam and the lever arm employed in the aforementioned co-pending application. In the present invention, a hollow actuating rod is provided so that the lower end of the actuating rod is received over the toggle arm of the microswitch. The upper end of the actuating rod is provided with a notch which will receive the strings which are attached to the first and last fish, referred to above. The end of each string is provided with a knot which rests against the side of the notch when the fish are first mounted on the fishing game device. When the first fish is first pulled away from the fishing game device, the string will pivot the actuating rod so as to move the toggle arm to actuate the timer. Continued pulling on this same fish will cause the knot to slip out of the notch so that the toggle arm of the microswitch will return to its initial position. This action starts the timer. In like manner, when the last fish is pulled away from the fishing game device, its associated string will again pivot the actuating rod to stop the timer and the knot on the string for the second fish will also slip out of the notch.

A patentability search was conducted on the present invention, and the following United States patents were uncovered in the search.

| U.S. Pat. No. | Inventor | Issue Date |
|---|---|---|
| 1,699,409 | Stevens | January 15 1929 |
| 2,511,430 | Colaluca | June 13, 1950 |
| 2,726,303 | Berndsen | December 6, 1955 |
| 2,931,878 | Eisenberg | April 5, 1960 |
| 3,617,676 | Dennison | November 2, 1971 |
| 3,959,618 | Carroll | May 25, 1976 |
| 3,997,750 | Glazer | December 14, 1976 |
| 4,115,669 | Cali | September 19, 1978 |
| 4,256,943 | Whitlock | March 17, 1981 |
| 4,615,624 | Goodrich | October 7, 1986 |
| 4,976,439 | Kraemer | December 11, 1990 |

The Berndsen U.S. Pat. No. 2,726,303 shows an attachment arm for a toggle switch and a string attached to the arm. The Dennison U.S. Pat. No. 3,617,676 shows an extension arm 38 for the lever of a switch 12.

SUMMARY OF THE INVENTION

The present invention involves a fishing game apparatus of the same general type disclosed in my co-pending application Ser. No. 07/667,178 where in a plurality of flat, relatively thin, fish-shaped members each having the outline of a fish and each being releasably attached to the horizontal support. A timing mechanism is associated with the fishing game apparatus in such a manner that the removal of a first preselected fish-shaped member will initiate the action and wherein the removal of a second preselected fish-shaped member will terminate the operation of the timing mechanism thereby determining the total lapsed time between the removal of the first preselected fish-shaped member and the removal of the last preselected fish-shaped member from the fishing game apparatus The timing mechanism is actuated by a microswitch having a momentary toggle arm. The improvement of the present invention includes an actuating rod having a lower end with a longitudinal bore therein. The size of the bore is such that the actuating rod can be snugly received over the toggle arm of the microswitch. The upper end of the actuating rod is provided with a vertical notch which extends downwardly. The actuating rod also preferably includes a circular opening or eye disposed above the notch. Each preselected fish-shaped member is provided with a string which connects at one end to the preselected fish-shaped member and which is provided with a knot at the other end of the string. When all of the fish are mounted on the horizontal support, the strings from the two preselected fish-shaped members are inserted into the opening in the actuating rod and slipped into the vertical notch. The strings are inserted into the notch in the reverse order of their removal. When the first member is removed from the horizontal support, its associated string will cause the actuating rod to pivot to actuate the timer after which the knot will slide up out of the notch to release the first preselected fish-shaped member from the apparatus. When the other preselected fish-shaped member is removed from the horizontal support, its associated string will cause the actuating rod to pivot to stop the timer, after which the knot on the end of the associated string will slide out of the notch to release the second preselected fish-shaped member from the fishing game apparatus.

DETAILED DESCRIPTION OF THE DRAWINGS

Figure 1:
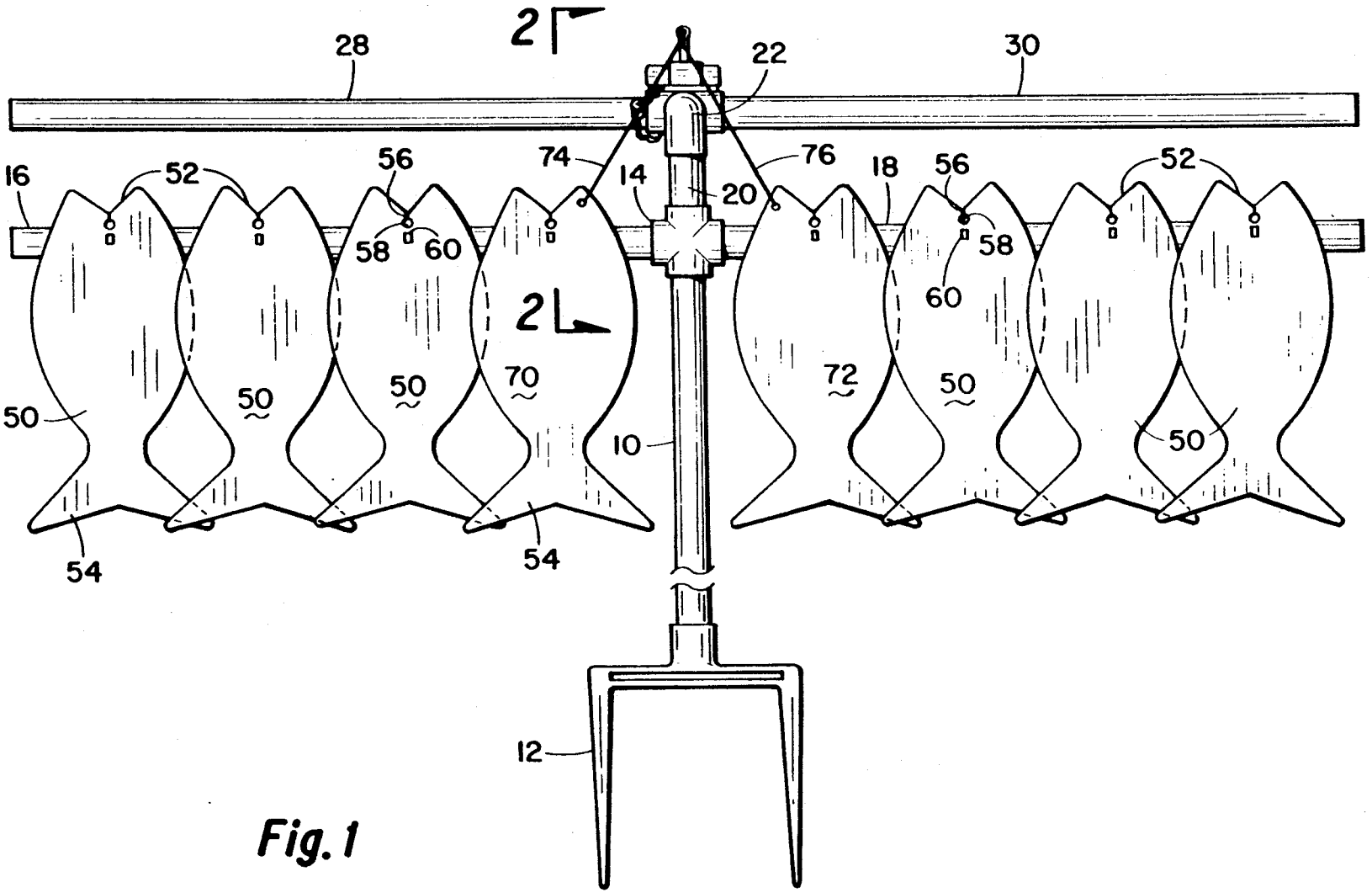
FIG. 1 is a front elevation of a fishing game device constructed in accordance with a preferred embodiment of the present invention.

Referring to the drawings in detail, FIG. 1 shows a fishing game apparatus, which is similar in many respects to the fishing game apparatus shown in FIG. 1 of the aforementioned co-pending application Ser. No. 07/667,178. The device in the present invention includes a vertical pipe 10 which can be impaled in the ground by means of a two-pronged fork 12. The top of the pipe 10 connects with a four-way coupling 14 which, in turn, connects with a pair of horizontal pipes 16 and 18 and a vertical pipe 20. The top of the pipe 20 (see FIG. 2) connects with an elbow 22. The elbow 22 connects with a short horizontal piece of pipe 24 which connects with a tee 26. The sides of the tee 26 connect with two horizontal pipes 28 and 30. At this juncture, it should appear that the pipes 28 and 30 are disposed parallel to, above and to the rear of, pipes 16 and 18 for purposes which are more fully set forth in my aforementioned co-pending application.

A microswitch 34, similar to the microswitch 134 disclosed in the aforementioned co-pending application, is mounted in the horizontal pipe 24 adjacent the tee 26. This microswitch is provided with the conventional momentary toggle arm 36. A timer or clock 38 is also mounted on the horizontal arm 24, although the timer could be mounted in any other convenient place on or adjacent the fishing game device of the present invention. The timer 38 is considered to be conventional and will not otherwise be described in any further detail except to state that the timer is connected to the microswitch by electrical wires 40.

FIG. 1 shows a plurality of fish-shaped members or "fish" 50 in the form of a thin plate of metal or plastic and having an outline resembling that of a fish. Each fish 50 has an angled mouth portion 52 at the upper end and a lower tail portion 54. The inner apex of the mouth 52 is provided with a narrow slot 56 which leads to a circular opening 58. Each fish is further provided with a second opening 60 disposed below the opening 58. The opening 60 is to provide a means for attachment of the fish 50 to the horizontal pipes 16 and 18 in a manner which will hereinafter appear.

Figure 2:
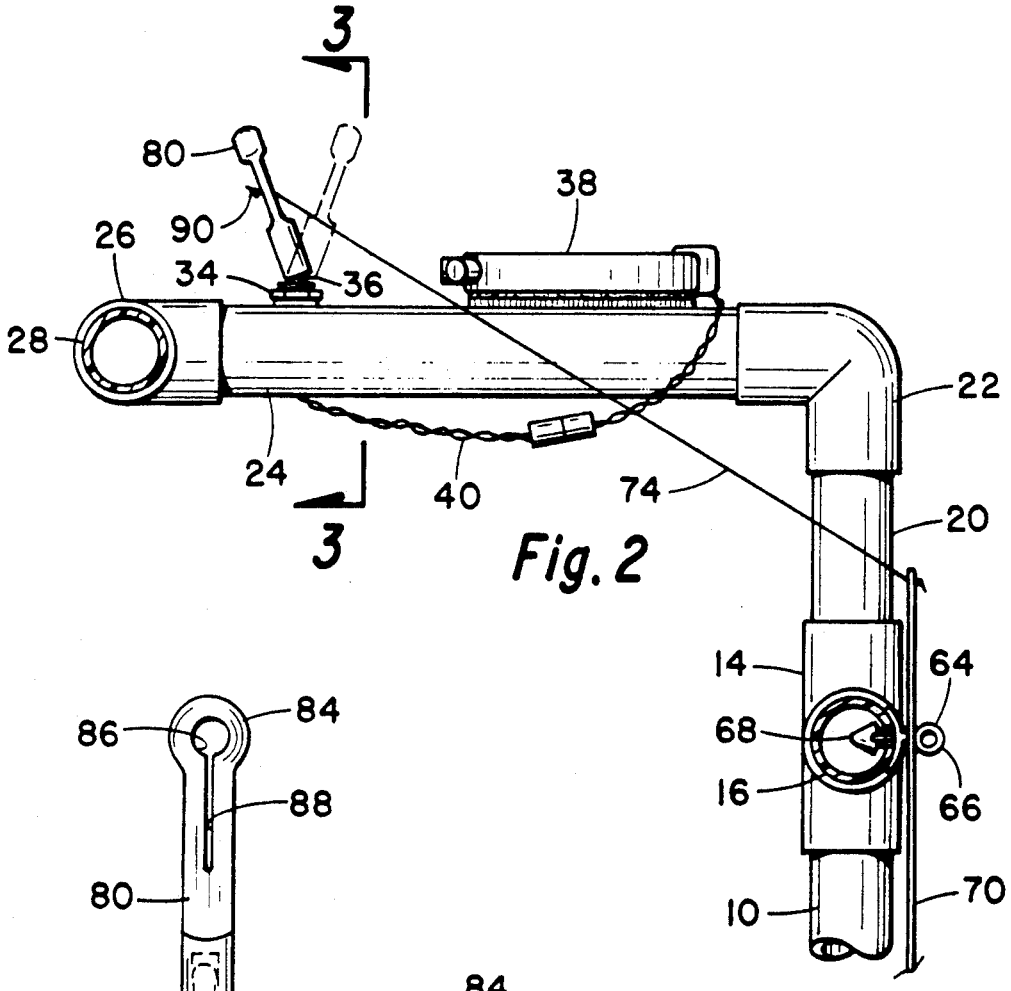
FIG. 2 is a sectional view, on a slightly enlarged scale, taken along section line 2—2 of FIG. 1 showing details of the upper portion of the fishing game device.

The pipes 16 and 18 are provided with a series of holes (not shown) along the lengths thereof, with these holes being positioned immediately behind the opening 60 in the fish 50. A resilient fastener 64, made of resilient material such as plastic or rubber, is adapted to be secured in each of the holes on the pipes 16 and 18. As best shown in FIG. 2, each fastener 64 is provided with a circular knob 66 at one end. The opposite end of the fastener 64 is provided with a tapered wedge 68. The wedge 68 has a maximum dimension larger than the hole in the pipe; however, the wedge 68 is of resilient material so it can be inserted through the hole in the pipe by squeezing the outer ends of the wedge. After the wedge passes through the hole in the pipe, the edges of the wedge will spring out and lock the wedge in place. The knob 66 has a maximum dimension slightly larger than the opening 60. However, this knob 66 is also resilient so that the fish 50 can be supported on the individual fasteners 64 by forcing the opening 30 over the knob 66. The knob 66 will compress slightly until the hole 30 comes to rest at the location, or recess, where the knob 66 connects with the wedge 68. Thus, the fish 50 shown in FIG. 1 are supported on the pipes 16 and 18 by means of the fasteners 64. However, a slight tug on the fish 50 away from the pipes 16 and 18 will cause the hole 30 of the pulled fish to pass over the knob 66 and thus be released.

The manner in which the fish are "caught" is more fully described in my co-pending application, using a casting rod, a winding reel and a special plug which cooperates with the circular opening 58 below the mouth of the fish.

As described in my prior co-pending application, the inside fish are used to stop and start the timer mechanism described therein. In like manner, the inside fish 70 and 72, shown in present FIG. 1, are used to start and stop the timer 38 in a manner which will be presently described. The inside fish 70 and 72 are identical to the other fish 50, except that these two fish, 70 and 72, are provided with strings 74 and 76 which are attached to the fish 70 and 72, respectively.

As indicated previously, the "inside" fish of the prior copending application actuated the timer means through a rotatable cam and a rotatable arm which is connected to the "inside" fish by means of a pair of strings. The present application eliminates the cam and the actuating arm therefor. Instead, the present invention includes an actuating rod 80 (see FIGS. 2 through 5).

The rod 80 is provided with an internal vertical bore 82 adjacent the lower end thereof and a circular eye 84 at the upper end thereof. The bore 82 is of sufficient size that it will accommodate the toggle arm 36 of the microswitch 34. Preferably, the bore 82 is sized so that it creates a snug fit when the actuating rod 80 is inserted over the actuating arm 36. The eye 84 includes an upper central opening 86 which leads downwardly to a vertical notch 88.

Figure 3:
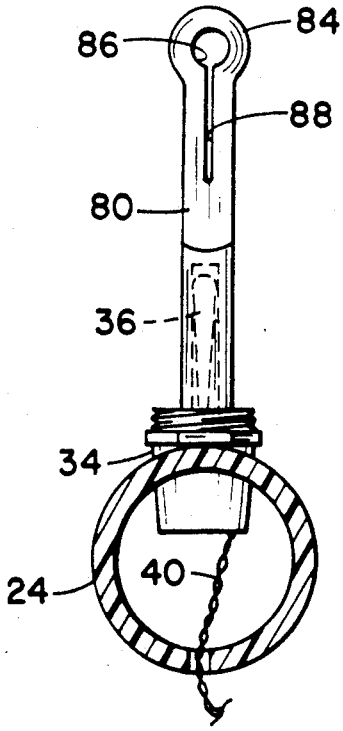
FIG. 3 is a sectional view, on an enlarged scale, taken along section lines 3—3 of FIG. 2.
Figure 4:
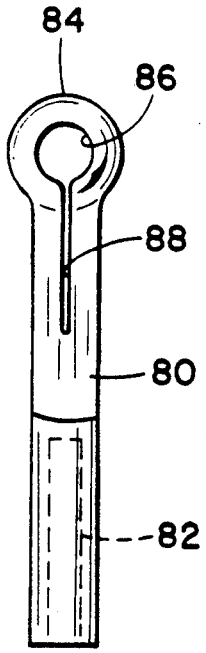
FIG. 4 is a front elevation of the actuating rod shown in FIG. 3.
Figure 5:
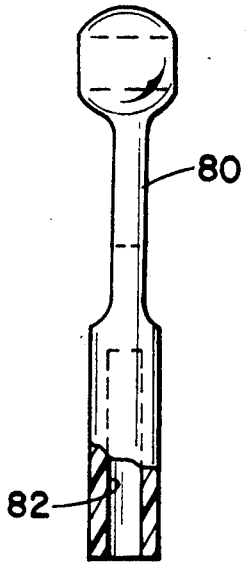
FIG. 5 is a side elevation, with a portion broken away and in section, of the actuating rod shown in FIG. 4.

After the actuating rod 80 has been attached to the actuating arm 36 of the microswitch 34, as shown in FIGS. 2 and 3, the strings 74 and 76 are inserted through the opening 86 and slipped downwardly into the notch 88. Each string 74, or 76, is provided with a knot 90 at the end thereof. The knots 90, therefore, will rest against the side of the notch 88. If the fish 70 is the fish to be used to start the timer sequence, then the string 74 will be put in last, i.e. over the string 76.

Assuming that the fish 70, which is used to initiate the timer 38, has been "caught" in the manner described in the aforementioned co-pending application, pulling on the fishing line (not shown) will first cause the fish 70 to be released from the releasable holding means 64; thereafter, continued pulling on the fishing line (not shown) will cause the string 74 to pivot the actuating rod 80 in a clockwise direction to the dotted line position shown in FIG. 2. The knot 90 will slip up the notch 88 and through the hole 86, thereby releasing the fish 70 totally from the fishing game device and allowing the actuating rod 80 and the microswitch 34 to return to the solid line position shown in FIG. 2. This action will then start the operation of the timer 38.

Later on, after all of the remaining fish 50 have been caught except for the fish 72, in the manner described in the aforementioned co-pending application, the game player will then "catch" the fish 72 and remove it from the device in the same manner described above in relation to the fish 70. The string 76 which would have been disposed in the notch 88 below the string 74 will now move the actuating arm 80 to the dotted line position shown in FIG. 2. The notch 90 on the end of the string 76 will slip up the notch 88 and thereby release the fish 72 from the fishing game device causing the microswitch 34 and the actuating arm 80 to return to the solid line position shown in FIG. 2 to stop the operation of the timer 38.

Whereas the present invention has been disclosed in terms of the specific structure described above, it should be understood that other and further modifications, apart from those shown or suggested herein, may be made within the spirit and scope of this invention.

What is claimed is:

1. In a fishing game apparatus of the type having a horizontal support, a plurality of flat, relatively thin, fish-shaped members each having the outline of a fish and each being releasably attached to the horizontal support, wherein a timing mechanism is associated with the apparatus, wherein the removal of a first preselected fish-shaped member will initiate the actuation of the timing mechanism and wherein the removal of a second preselected fish-shaped member will terminate the operation of the timing mechanism, wherein the timing mechanism is actuated by a microswitch having a momentary toggle arm, the improvement which comprises an actuating rod having an upper end and a lower end, the lower end of the actuating rod having a bore adapted to snugly receive the toggle arm of the microswitch, the upper end of the actuating rod being provided with a vertical notch, each preselected fish-shaped member being provided with a string which connects at one end to the preselected fish-shaped member and which has another knotted end adapted to be received in the notch of the actuating rod whereby removal of the first preselected fish-shaped member from the horizontal support will cause the string of the first preselected fish-shaped member to pivot the actuating rod to actuate the timer, after which the knot on the end of the string will slide out of the notch to release the first preselected fish-shape member from the fishing game apparatus and initiate the operation of the timer and whereby removal of the second preselected fish-shaped member from the horizontal support will cause its associated string to pivot the actuating rod a second time, followed by the sliding of the knot on the associated string of the second preselected fish-shaped member out of the notch to release the second preselected fish-shaped member from the fishing game apparatus and to actuate the microswitch to stop the timer.

2. In a fishing game apparatus of the type having a horizontal support, a plurality of flat, relatively thin, fish-shaped members each having the outline of a fish and each being releasably attached to the horizontal support, wherein a timing mechanism is associated with the apparatus, wherein the removal of a first preselected fish-shaped member will initiate the actuation of the timing mechanism and wherein the removal of a second preselected fish-shaped member will terminate the operation of the timing mechanism, wherein the timing mechanism is actuated by a microswitch having a momentary toggle arm, the improvement which comprises an actuating rod having an upper end and a lower end, the lower end of the actuating rod having a bore adapted to snugly receive the toggle arm of the microswitch, the upper end of the actuating rod being provided with and opening and a vertical notch, which extends downwardly from the opening, each preselected fish-shaped member being provided with a string which connects at one end to the preselected fish-shaped member and which has another knotted end adapted to pass through the opening in the actuating rod and be received in the notch of the actuating rod whereby removal of the first preselected fish-shaped member from the horizontal support will cause the string of the first preselected fish-shaped member to pivot the actuating rod to actuate the timer, after which the knot on the end of the string will slide out of the notch and through the opening to release the first preselected fish-shape member from the fishing game apparatus and initiate the operation of the timer and whereby removal of the second preselected fish-shaped member from the horizontal support will cause its associated string to pivot the actuating rod a second time, followed by the sliding of the knot on the associated string of the second preselected fish-shaped member out of the notch and out of the opening of the actuating rod to release the second preselected fish-shaped member from the fishing game apparatus and to actuate the microswitch to stop the timer.

* * * * *